US012650125B2

(12) United States Patent
Lee et al.

(10) Patent No.: US 12,650,125 B2
(45) Date of Patent: Jun. 9, 2026

(54) ELECTRONIC OIL PUMP

(71) Applicant: COAVIS, Sejong-si (KR)

(72) Inventors: Hyuntae Lee, Sejong-si (KR); Wookeun Lee, Sejong-si (KR); Hyukjin Lee, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 18/605,693

(22) Filed: Mar. 14, 2024

(65) Prior Publication Data

US 2024/0328414 A1 Oct. 3, 2024

(30) Foreign Application Priority Data

Mar. 28, 2023 (KR) ..... 10-2023-0040517

(51) Int. Cl.
*F04C 2/10* (2006.01)
*F04C 11/00* (2006.01)
*F04C 15/00* (2006.01)

(52) U.S. Cl.
CPC ..... *F04C 2/10* (2013.01); *F04C 2/102* (2013.01); *F04C 11/008* (2013.01); *F04C 15/0096* (2013.01); *F04C 2210/206* (2013.01); *F04C 2240/30* (2013.01); *F04C 2240/40* (2013.01)

(58) Field of Classification Search
CPC ..... F04C 2/10; F04C 2/102; F04C 11/008; F04C 15/0096; F04C 2210/206; F04C 2240/30; F04C 2240/40
See application file for complete search history.

(56) References Cited

U.S. PATENT DOCUMENTS

2013/0089452 A1* 4/2013 Lee ..... F04C 15/068 418/164

FOREIGN PATENT DOCUMENTS

JP 2017101796 A * 6/2017
KR 101230044 B1 2/2013

* cited by examiner

*Primary Examiner* — Anthony Ayala Delgado
(74) *Attorney, Agent, or Firm* — McCoy Russell LLP

(57) ABSTRACT

Provided is an electronic oil pump for circulating oil by driving an electric motor, and more particularly, an electronic oil pump which may ensure rotational stability of a gerotor and minimize a pumping loss by cooling the electric motor by using pumped oil.

7 Claims, 7 Drawing Sheets

S2(111, 152), D2(113, 154), 190(110, 150)

[FIG. 1]
(PRIOR ART)
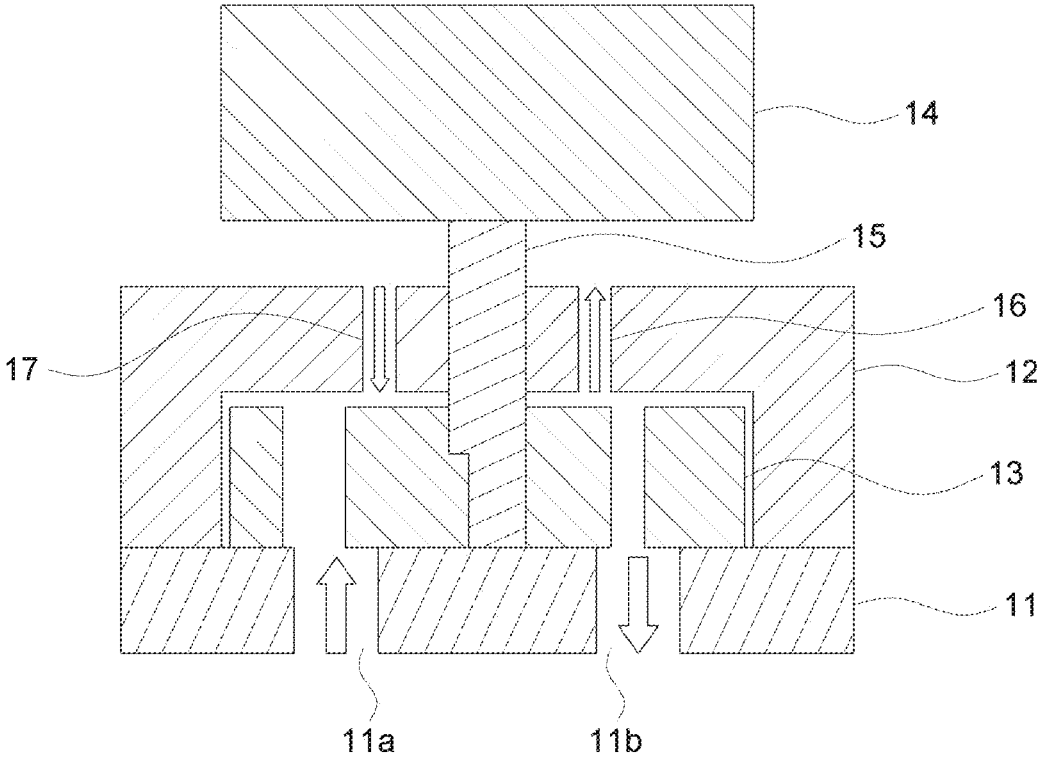

[FIG. 2]
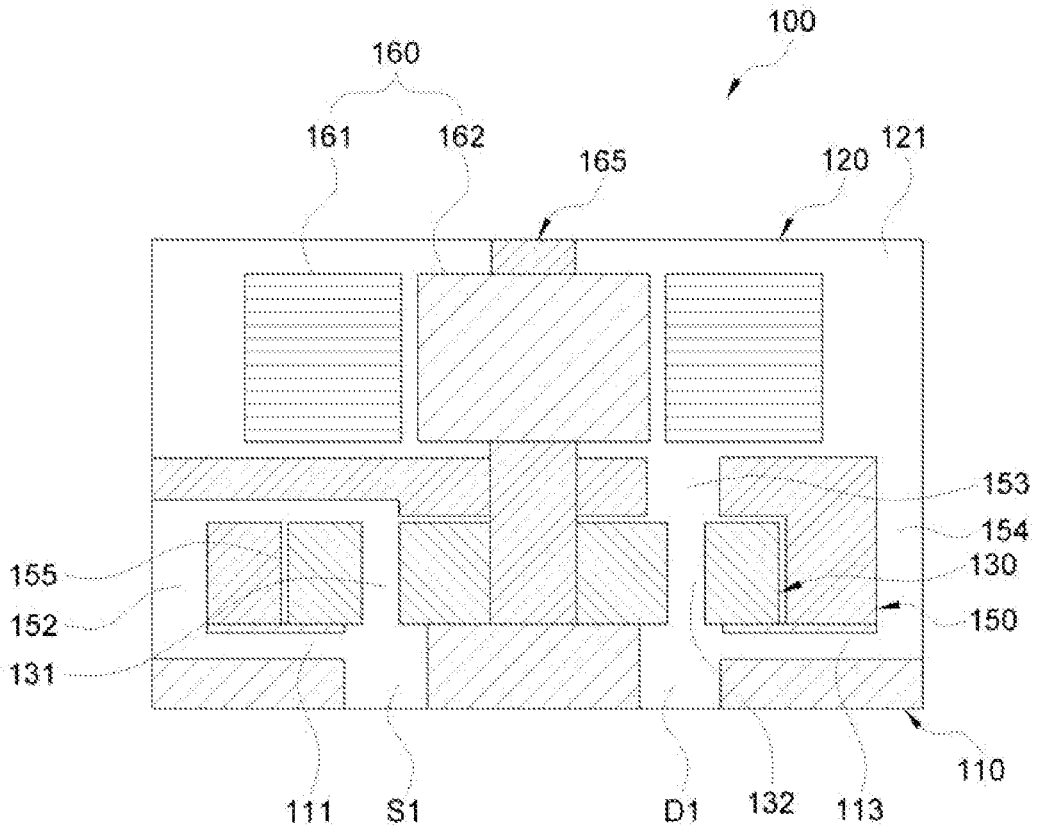
S2(111, 152), D2(113, 154), 190(110, 150)

[FIG. 3]
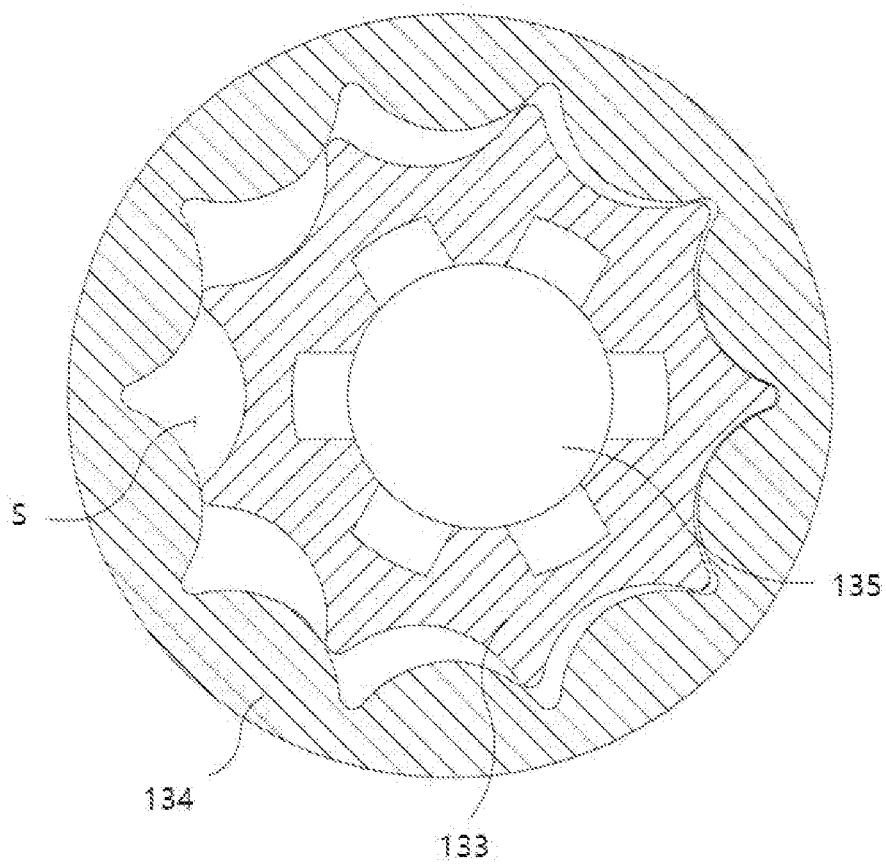

[FIG. 4]
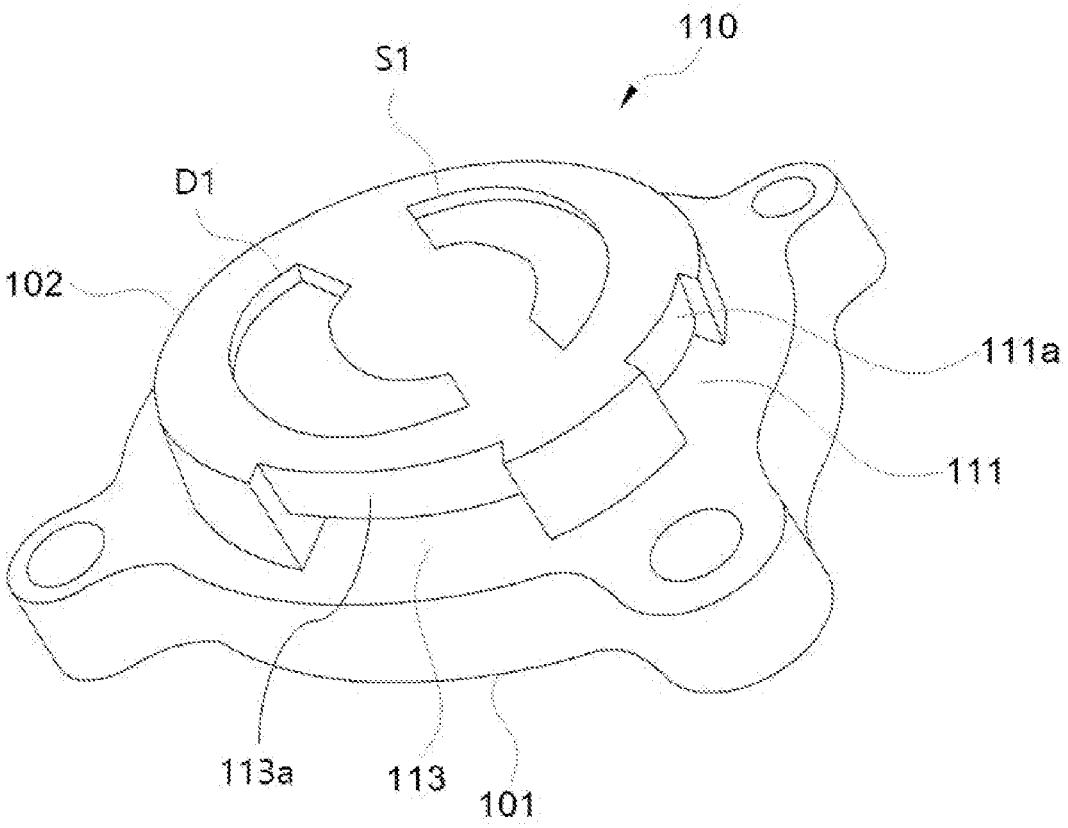

[FIG. 5]
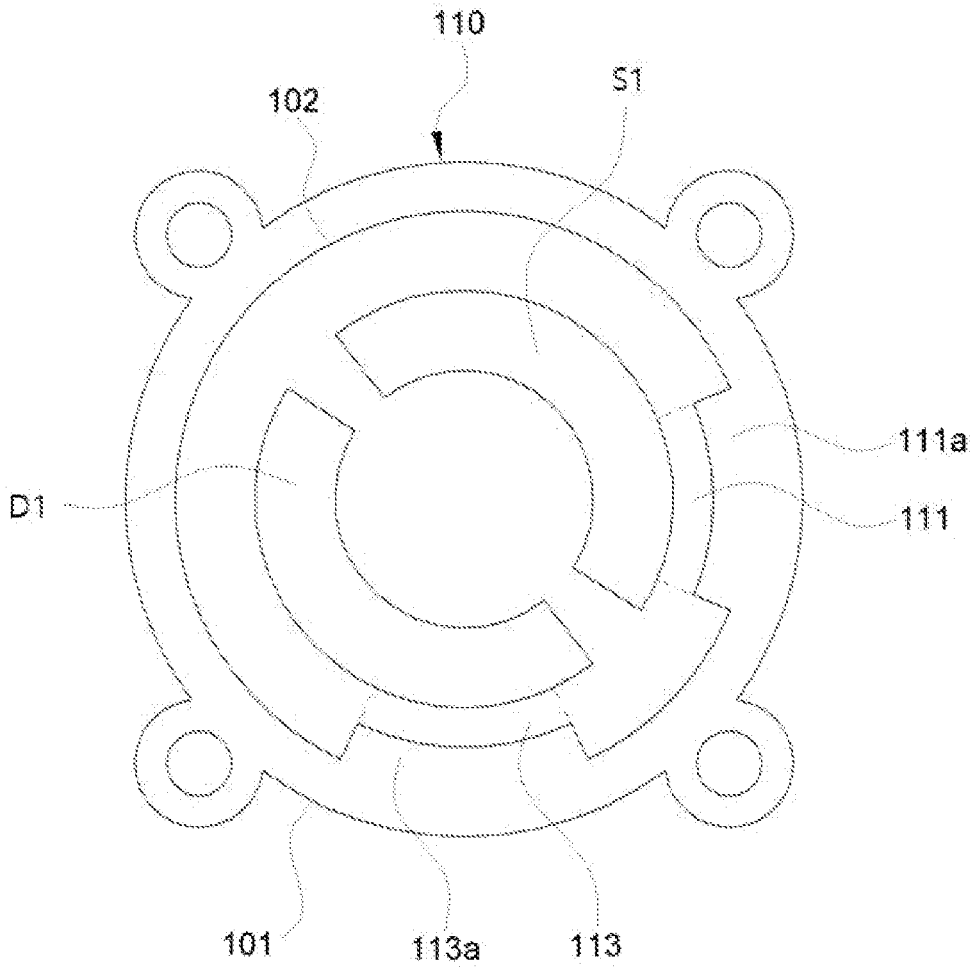

[FIG. 6]
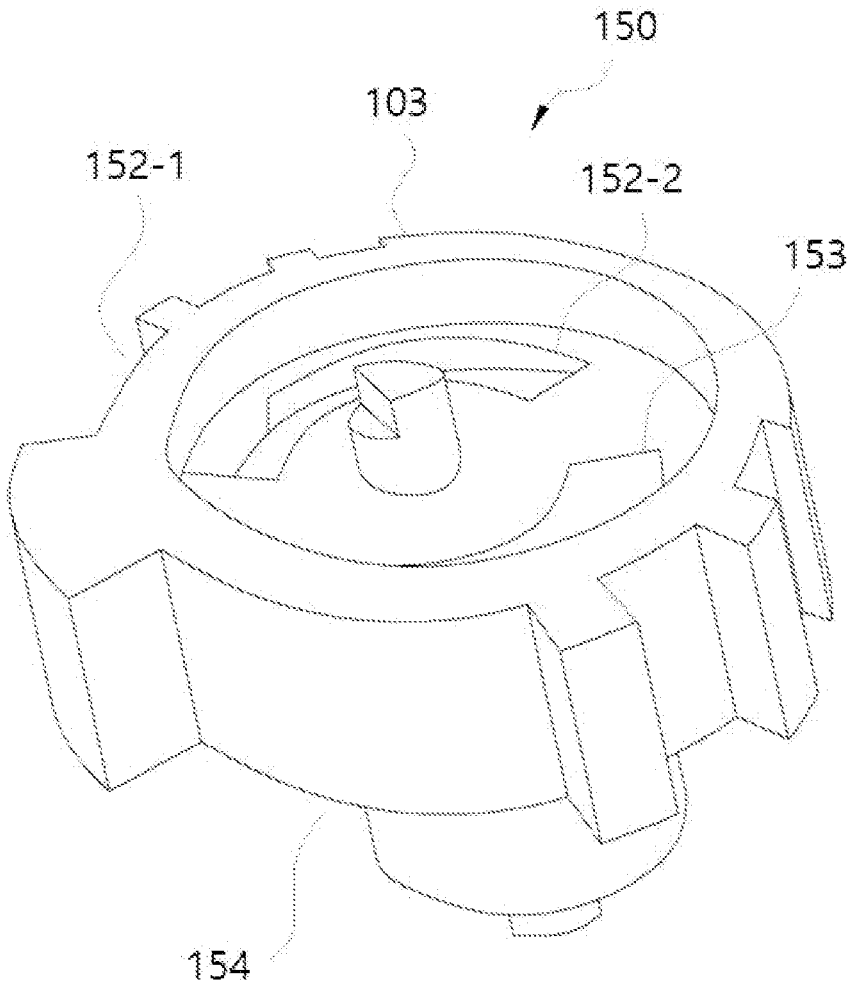

[FIG. 7]
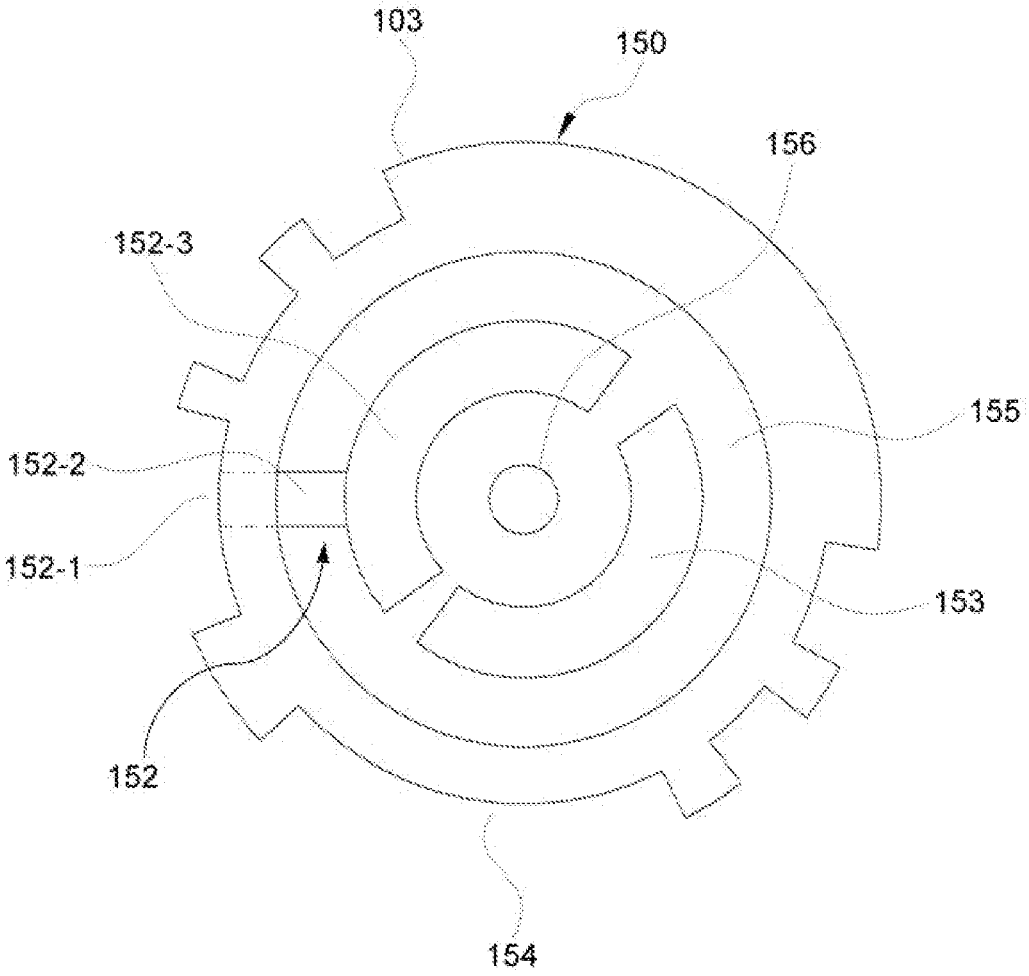

ELECTRONIC OIL PUMP

CROSS-REFERENCE TO RELATED APPLICATIONS

This application claims priority under 35 U.S.C. § 119 to Korean Patent Application No. 10-2023-0040517, filed on Mar. 28, 2023, in the Korean Intellectual Property Office, the disclosure of which is incorporated herein by reference in its entirety.

TECHNICAL FIELD

The following disclosure relates to an electronic oil pump for circulating oil by driving an electric motor, and more particularly, to an electronic oil pump which may ensure rotational stability of a gerotor and minimize a pumping loss by cooling the electric motor by using pumped oil.

BACKGROUND

A vehicle oil pump may be a pump used to circulate oil for lubrication of a vehicle part, such as engine oil or transmission oil. The oil pump may circulate oil into an engine or a transmission to reduce friction between the parts and lubricate the same to reduce wear and maintain its normal operation.

The oil pump installed in an internal combustion engine vehicle may be operated using a rotational force of the engine. In general, the oil pump may be directly connected to a crankshaft of the engine and receive a drive force. The oil pump may be designed to maintain constant pressure and flow rate, and serve an important function in maintaining oil cleanliness and extending a lifespan of the engine when used with an oil filter.

In recent years, an electronic oil pump has also been developed and is being used as the vehicle oil pump. The electric oil pump may make less noise than an existing mechanical pump, and efficiently control oil to perform more efficient lubrication.

In particular, a vehicle having no engine, such as an electric vehicle, may use the electronic oil pump using electricity as its drive source, and the electric motor of the electric vehicle may be operated in a high-temperature, high-speed, and high-pressure environment. Therefore, an internal part of the electric motor may require sufficient lubrication. In addition, a gearbox may use a plurality of gears to transmit power, and require lubrication to maintain a gap between the respective gears and transmit the rotational force. Therefore, the electronic oil pump used in the electric vehicle may be designed to supply lubricating oil necessary for an operation of the electric motor or that of the gearbox.

The oil pump of the electric vehicle may provide appropriate pressure and flow rate while minimizing power consumption and noise, and may be connected to a motor control device to enable precise flow rate control of the lubricating oil. Therefore, the oil pump may be one of important components affecting the driving distance or performance of the electric vehicle.

FIG. 1 is a schematic view showing a main part of a conventional electronic oil pump 10. As shown in the drawing, the oil pump 10 may include a first case 11 having an oil inlet 11*a* and an oil outlet 12*b* formed therein, a second case 12 coupled to the first case 11 and having an oil circulation space therein, a gerotor 13 accommodated in a second case 12 and rotated to suction oil from the oil inlet

11*a* and discharge oil to the oil outlet 11*b*, and a shaft 15 for transmitting a drive force of an electric motor 14 to the gerotor 13. The oil pump 10 may further include a first cooling passage 16 for supplying a portion of oil discharged from the gerotor 13 to a space where the electric motor 14 is accommodated to cool heat occurring by the electric motor 14 by using pumped oil, and a second cooling passage 17 for flowing oil cooling the electric motor 14 into a suction part of the gerotor 13.

In the conventional electronic oil pump 10 described as above, a portion of oil pumped by the gerotor 13 may leak into the electric motor accommodation space, and oil cooling the electric motor may also flow into the gerotor 13. Therefore, a loss in a pumping flow rate may occur, and a pressure imbalance may occur when driving the gerotor 13, which may reduce durability of the gerotor 13.

In addition, a load may be increased due to the first and second cooling passages 16 and 17 when the gerotor 13 is rotated at a high speed, and a required pumping flow rate cannot be satisfied especially when an oil viscosity is high.

SUMMARY

An embodiment of the present disclosure is directed to providing an electronic oil pump which may cool a motor by using oil, and prevent a pumping loss by discharging oil supplied to a motor cooling space directly to a pump discharge part.

Another embodiment of the present disclosure is directed to providing an electronic oil pump which may reduce oil flow resistance and maintain a rotational balance of a gerotor by configuring a passage of oil supplied to a suction part of the gerotor in two directions, and configuring a passage of oil discharged to the discharge part of the gerotor in two directions.

Still another embodiment of the present disclosure is directed to providing an electronic oil pump which may have a less packaging and a simpler manufacturing process by forming a gerotor supply passage and a gerotor discharge passage by using a case accommodating a gerotor.

In one general aspect, an electronic oil pump includes: a body case having one side where the first suction passage and first discharge passage of a fluid are formed, and installed with a gerotor; an upper case having one side open, having a cooling space formed therein, and having the body case coupled to an open surface of the one side; a gerotor installed in the body case, and including an internal rotor and an external rotor engaged with each other to be eccentrically rotated for one side of its suction part to communicate with the first suction passage, and one side of its discharge part to communicate with the first discharge passage; and an electric motor installed in the cooling space, and including a shaft for transmitting a rotational force to the gerotor, wherein the body case includes a cooling inflow passage for supplying the fluid in the discharge part to the cooling space by allowing the other side of the discharge part of the gerotor and the cooling space to communicate with each other; and a second discharge passage for supplying the fluid in the cooling space to the first discharge passage by allowing the cooling space and the first discharge passage to communicate with each other.

The body case may further include a second suction passage branched off from the first suction passage, and communicating with the other side of the suction part of the gerotor.

The body case may include a lower case having one side where the first suction passage and first discharge passage of the fluid are formed, and a central case coupled to the other side of the lower case and having one side where a seating part on which the gerotor is seated is formed, and the second suction passage may include a first connection passage and a second connection passage, the first connection passage being formed in the lower case, and having an upstream end communicating with the first suction passage and a downstream end communicating with the second connection passage, and the second connection passage being formed in the central case, and having an upstream end communicating with the first connection passage and a downstream end communicating with the other side of the suction part of the gerotor.

The body case may include a lower case having one side where the first suction passage and the first discharge passage of the fluid are formed, and a central case coupled to the other side of the lower case and having one side where a seating part on which the gerotor is seated is formed, and the second discharge passage may include a cooling leakage passage and a third connection passage, the cooling leakage passage being formed in the central case, and having an upstream end communicating with the cooling space and a downstream end communicating with the third connection passage, and the third connection passage being formed in the lower case, and having an upstream end communicating with the cooling leakage passage and a downstream end communicating with the first discharge passage.

The central case may be made of the same material as the lower case or a material having high thermal conductivity.

The lower case may include a bottom plate having the upstream end of the first suction passage and the downstream end of the first discharge passage formed therein, and a first body having a smaller diameter than that of the bottom plate and protruding to the other side of the bottom plate, the central case may include a second body having a cylindrical shape in a shaft direction, and the seating part having a smaller diameter than that of the second body and recessed by a certain distance from one surface of the second body to the other side, the first connection passage may be formed as a groove by being recessed by a certain distance from one end of the first body to the other side while passing through in a radial direction for its radial inner side to communicate with the first suction passage and its radial outer side to communicate with the second connection passage, and the second connection passage may include a 2-1-th passage recessed from an outer surface of the second body to its radial inner side, and formed from one surface of the second body to the other surface in a length direction to communicate with the downstream end of the first connection passage, a 2-2-th passage passing through the second body in the radial direction for its upstream end to communicate with the 2-1 passage and its downstream end to communicate with the seating part, and a 2-3-th passage recessed from the other surface of the seating part to the other side for its upstream end to communicate with the 2-2 passage and its downstream end to communicate with the other side of the suction part of the gerotor which is seated on the seating part.

The lower case may include a bottom plate having the upstream end of the first suction passage and the downstream end of the first discharge passage formed therein, and a first body having a smaller diameter than that of the bottom plate and protruding to the other side of the bottom plate, the central case may include a second body having a cylindrical shape in a shaft direction, and the seating part having a smaller diameter than that of the second body and recessed by a certain distance from one surface of the second body to the other side, the cooling leakage passage may be recessed from an outer surface of the second body to its radial inner side, and formed from one surface of the second body to the other surface in a length direction for the other side to communicate with the cooling space and its one side to communicate with the third connection passage, and the third connection passage may be formed as a groove by being recessed by a certain distance from one end of the first body to the other side while passing through in a radial direction and by including a groove recessed by a certain distance from a radial outer side of the first body to its radial inner side for its radial outer side to communicate with the cooling leakage passage and its radial inner side to communicate with the first discharge passage.

The cooling inflow passage may pass through the other surface of the seating part to the other surface of the second body for its upstream end to communicate with the other side of the discharge part of the gerotor which is seated on the seating part, and its downstream end to communicate with the cooling space.

The upper case may accommodate the central case in its center in the shaft direction, have an inner circumferential surface in close contact with and coupled to an outer circumferential surface of the second body, and have one end in contact with and coupled to a circumference of the other side of the bottom plate and an inner surface of the one end in contact with and coupled to an outer surface of the first body.

Other features and aspects will be apparent from the following detailed description, the drawings, and the claims.

BRIEF DESCRIPTION OF THE DRAWINGS

FIG. 1 is a schematic view of a conventional electronic oil pump.

FIG. 2 is a schematic cross-sectional view of an electronic oil pump according to an embodiment of the present disclosure.

FIG. 3 is a transversal cross-sectional view of a gerotor according to an embodiment of the present disclosure.

FIG. 4 is a perspective view of a lower case of the electronic oil pump according to an embodiment of the present disclosure.

FIG. 5 is a plan view of the lower case of the electronic oil pump according to an embodiment of the present disclosure.

FIG. 6 is a bottom perspective view of a central case of the electronic oil pump according to an embodiment of the present disclosure.

FIG. 7 is a bottom view of the central case of the electronic oil pump according to an embodiment of the present disclosure.

DETAILED DESCRIPTION OF EMBODIMENTS

Hereinafter, an embodiment of the present disclosure is described in detail with reference to the accompanying drawings.

FIG. 2 is a schematic cross-sectional view of an electronic oil pump 100 according to an embodiment of the present disclosure; and FIG. 3 is a transversal cross-sectional view of a gerotor 130 according to an embodiment of the present disclosure. The description is provided by defining a lower side of the drawing in FIG. 2 as one side and an upper side of the drawing as the other side.

As shown in FIG. 2, the oil pump 100 may include: a body case 190 including a lower case 110 and a central case 150;

an upper case 120; the gerotor 130 accommodated in the central case 150; and an electric motor 160 accommodated in the upper case 120.

The lower case 110 may be disposed on one side of the oil pump 100, and have a first suction passage S1 and a first discharge passage D1 formed in one surface thereof. In addition, the gerotor 130 may be mounted on the lower case 110, a downstream end of the first suction passage S1 may communicate with one side of a suction part 131 of the gerotor 130, an upstream end of the first discharge passage D1 may communicate with one side of a discharge part 132 of the gerotor 130. In addition, the lower case 110 may further include a second suction passage S2 for supplying oil to the other side of the suction part 131 of the gerotor 130. The second suction passage S2 may include a first connection passage 111 formed in the lower case 110 and a second connection passage 152 formed in the central case 150. Therefore, the second suction passage S2 may be formed by coupling of the lower case 110 and the central case 150. The first connection passage 111 may have an upstream end branched off from the first suction passage S1, and a downstream end open to the central case 150.

Meanwhile, the oil pump 100 may further include a second discharge passage D2 for transmitting oil discharged from a cooling space 121 to the first discharge passage D1. The second discharge passage D2 may include a cooling leakage passage 154 formed in the central case 150 and a third connection passage 113 formed in the lower case 110. Therefore, the second discharge passage D2 may be formed by coupling of the lower case 110 and the central case 150. The third connection passage 113 may have an upstream end open to the central case 150, and a downstream end communicating with the first discharge passage D1.

The central case 150 may be coupled to the other side of the lower case 110. In addition, the central case 150 may have a seating part 155 on which the gerotor 130 is seated therein. The seating part 155 may be recessed from one surface of the central case 150 to the other side. A shaft through hole 156 (see FIG. 7) through which a shaft 165 of the electric motor 160 for rotating the gerotor 130 passes may be formed in the seating part 155. In addition, the central case 150 may include the second connection passage 152 formed therein and having an upstream end communicating with the downstream end of the first connection passage 111 to supply oil to the other side of the suction part 131 of the gerotor 130, and a downstream end communicating with the other side of the suction part 131 of the gerotor 130. In addition, the central case 150 may include a cooling inflow passage 153 having an upstream side communicating with the other side of the discharge part 132 of the gerotor 130 and a downstream side communicating with the cooling space 121 for oil discharged to the other side of the discharge part 132 of the gerotor 130 to be supplied to the cooling space 121 where the electric motor 160 of the upper case 120 is installed. In addition, the central case 150 may include the cooling leakage passage 154 having an upstream end communicating with the cooling space 121, and a downstream end communicating with the upstream end of the third connection passage 113 for oil discharged from the cooling space 121 to be transmitted to the third connection passage 113.

The upper case 120 may have a box shape with one side open, and have the cooling space 121 where the electric motor 160 is installed in the other side. In addition, the upper case 120 may accommodate the central case 150 in the center thereof, and seal an open surface of its one side by being coupled with the lower case 110. As described above, the cooling space 121 of the upper case 120 may receive oil by communicating with the cooling inflow passage 153 of the central case 150, and discharge oil cooling the electric motor 160 by communicating with the cooling leakage passage 154.

Meanwhile, the central case 150 may be made of a resin material like the lower case 110 or the upper case 120, or may be made of a metal material having high thermal conductivity. When the central case 150 is made of a thermally conductive material, oil flowing in the gerotor 130 seated on the seating part 155 and oil flowing in the cooling space 121 may exchange heat with each other. Accordingly, the electric motor 160 may be indirectly cooled by oil flowing through the gerotor 130.

Referring to FIG. 3, the gerotor 130 may include an internal rotor 133 and an external rotor 134. The gerotor 130 may be rotated with a rotation ratio of (N+1)/N in a state where the internal rotor 133 has N lobes, and the external rotor 134 has N+1 lobes. In addition, the internal rotor 133 and the external rotor 134 may have a constant eccentricity centered on an eccentric hole 135, and the eccentricity may provide a volumetric part S in which a fluid fuel may be transported between the internal rotor 133 and the external rotor 134. The volumetric part S may repeat its increase and decrease during the rotation of the gerotor 130, and have a volume change rate determined by a tooth profile of the rotated rotor. During the rotation, a portion of the volumetric part S where a volume is increased may suction a surrounding fluid due to a pressure drop, and its portion where the volume is decreased may discharge the fluid due to a pressure rise. As described above, the gerotor 130 may transport the fluid by the increase and decrease of the volumetric part S. However, for convenience, the description defines the portion where the volume is increased as the suction part 131 and the portion where the volume is decreased as the discharge part 132.

As shown in FIG. 2, the gerotor 130 having the above configuration may be seated on the seating part 155 of the central case 150, mounted on the other side of the lower case 110, and coupled to the shaft 165 to thus allow the internal rotor 133 or the external rotor 134 to be rotated by driving the shaft 165. Here, the suction part 131 may have one side communicating with the first suction passage S1, and the other side communicating with the second suction passage S2. In addition, the discharge part 132 may have one side communicating with the first discharge passage D1 to pump oil to the outside, and the other side communicating with the cooling inflow passage 153 to discharge oil into the cooling space 121. That is, the gerotor 130 may suction oil in two directions of the suction part 131 and discharge oil in two directions of the discharge part 132.

The electric motor 160 may include a stator 161 fixed to the upper case 120 in the cooling space 121, and a rotor 162 installed inside the stator 161 and rotated by an electricity supply. In addition, the shaft 165 may be coupled to the rotor 162 to transmit a rotational force of the rotor 162 to the gerotor 130. In addition, the electric motor 160 may be cooled through its heat exchange with oil supplied through the cooling inflow passage 153.

The oil flow of the oil pump 100 having the above configuration is described in more detail.

When the gerotor 130 is rotated by the shaft 165, the suction part 131 where the volumetric part S is increased may have a low pressure formed therein to thus suction oil through the first suction passage S1 communicating with one side of the suction part 131 and the second suction passage S2 communicating with the other side of the suction part 131. In addition, the discharge part 132 where the volumetric part S is decreased may have a high pressure formed therein to thus discharge oil suctioned into the volumetric part S. Here, one side of the discharge unit 132 may communicate with the first discharge passage D1 to discharge pumped oil, and the other side of the discharge unit 132 may communicate with the cooling space 121 through the cooling oil passage 153 to discharge oil to the cooling space 121. Oil discharged to the cooling space 121 may cool the electric motor 160 heated for a certain time, and then flow into the first discharge passage D1 through the second discharge passage D2 communicating with the cooling space 121 to be discharged to the outside.

FIG. 4 is a perspective view of the lower case 110 of the electronic oil pump 100 according to an embodiment of the present disclosure; and FIG. 5 is a plan view of the lower case 110 of the electronic oil pump 100 according to an embodiment of the present disclosure.

As shown in the drawings, the lower case 110 may include a bottom plate 101 having the upstream end of the first suction passage S1 and the downstream end of the first discharge passage D1 formed therein, and a first body 102 having a smaller diameter than that of the bottom plate 101 and protruding to the other side of the bottom plate 101. Meanwhile, the upper case 120 may have one end in contact with and coupled to a circumference of the other side of the bottom plate 101 and an inner surface of one end in contact with and coupled to an outer surface of the first body 102.

The gerotor 130 may be seated on the other surface of the first body 102, the downstream end of the first suction passage S1 may pass through a portion corresponding to the suction part 131 of the gerotor 130, and the upstream end of the first discharge passage D1 may pass through a portion corresponding to the discharge part 132.

In addition, the first body 102 may have the first connection passage 111 allowing a radial outer side of the first body 102 and the first suction passage S1 to communicate with each other, and the third connection passage 113 allowing the radial outer side of the first body 102 and the first discharge passage D1 to communicate with each other. Here, the first connection passage 111 and the third connection passage 113 may be separated from each other, and each of the first connection passage 111 and the third connection passage 113 may be formed as a groove by being recessed by a certain distance from one end of the first body 102 to the other side while passing through in a radial direction. That is, a radial inner side of the first connection passage 111 may communicate with the first suction passage S1, and a radial inner side of the third connection passage 113 may communicate with the first discharge passage D1.

In addition, the first connection passage 111 and the third connection passage 113 may each include the following component to have the other side open to the central case 150 when coupled with the upper case 120.

The first connection passage 111 and the third connection passage 113 may each include a first communication groove 111*a* and a second communication groove 113*a* that are recessed by a certain distance from the radial outer side of the first body 102 to its radial inner side.

FIG. 6 is a bottom perspective view of the central case 150 of the electronic oil pump 100 according to an embodiment of the present disclosure; and FIG. 7 is a bottom view of the central case 150 of the electronic oil pump 100 according to an embodiment of the present disclosure.

As shown in the drawings, the central case 150 may include a second body 103 having a cylindrical shape in a shaft direction, and the seating part 155 having a smaller diameter than that of the second body 103 and recessed by a certain distance from one surface of the second body 103 to the other side. Here, the upper case 120 may accommodate the central case 150 in its center in the shaft direction, and have an inner circumferential surface in close contact with and coupled to an outer circumferential surface of the second body 103. In addition, in the central case 150, one surface of the second body 103, on which the gerotor 130 is seated, may be coupled to the other surface of the first body 102.

In addition, the second connection passage 152 may be formed in the second body 103 for oil to be supplied to the other side of the suction part 131 of the gerotor 130 which is seated on the seating part 155. The second connection passage 152 may include 2-1-th to 2-3-th passages 152-1, 152-2, and 152-3. The 2-1-th passage 152-1 may be recessed from an outer surface of the second body 103 to its radial inner side. In addition, the 2-1-th passage 152-1 may be formed from one surface of the second body 103 to the other surface in a length direction. The 2-1-th passage 152-1 may have an upstream end communicating with the first communication groove 111*a* (see FIG. 5) of the first connection passage 111 when the lower case 110 and the central case 150 are coupled with each other. The 2-2-th passage 152-2 may pass through the second body 103 in the radial direction for its upstream end to communicate with the 2-1-th passage 152-1 and its downstream end to communicate with the seating part 155. The 2-3-th passage 152-3 may be recessed from the other surface of the seating part 155 to the other side for its upstream end to communicate with the 2-2-th passage 152-2 and its downstream end to communicate with the other side of the suction part 131 of the gerotor 130 which is seated on the seating part 155.

In addition, the cooling inflow passage 153 may be formed in the second body 103 for oil discharged from the discharge part 132 of the gerotor 130 to be supplied to the cooling space 121. The cooling inflow passage 153 and the 2-3-th passage 152-3 may be spaced apart from each other. The cooling inflow passage 153 may pass through the other surface of the seating part 155 to the other surface of the second body 103 for its upstream end to communicate with the other side of the discharge part 132 of the gerotor 130 which is seated on the seating part 155, and for its downstream end to communicate with the cooling space 121.

In addition, the cooling leakage passage 154 may be formed in the second body 103 for oil in the cooling space 121 to be supplied to the third connection passage 113 of the lower case 110. The cooling leakage passage 154 may be recessed from the outer surface of the second body 103 to its radial inner side. In addition, the cooling leakage passage 154 may be formed from one surface of the second body 103 to the other surface in the length direction. The cooling leakage passage 154 may be separated from the 2-1-th passage 152-1. The cooling leakage passage 154 may have the downstream end communicating with the second communication groove 113*a* (see FIG. 5) of the third connection passage 113, and the upstream end exposed to the cooling space 121 when the central case 150 is coupled to the lower case 110.

As set forth above, the electronic oil pump having the above configuration according to the present disclosure may minimize the pumping loss caused by oil supplied to the motor cooling space and oil flowing into the gerotor space in addition to a basic effect of cooling the motor by using pumped oil.

In addition, the electronic oil pump may improve the pumping efficiency by minimizing the flow resistance when suctioning oil from the gerotor and when discharging oil.

In addition, the electronic oil pump may have the improved gerotor durability and enable the stable pumping because the electronic oil pump may be stably rotated as the suction and discharge of the gerotor are performed in the two directions, thus preventing its rotation under the load on one side.

In addition, the electronic oil pump may have the lower manufacturing costs and the improved productivity by using the fewer parts and the simpler manufacturing process because the passage flowing into or discharged to the gerotor is formed in the case where the gerotor is seated and fixed.

The spirit of the present disclosure should not be limited to an embodiment described above. The present disclosure may be applied to various fields and may be variously modified by those skilled in the art without departing from the scope of the present disclosure claimed in the claims. Therefore, it is obvious to those skilled in the art that these alterations and modifications fall within the scope of the present disclosure.

DETAILED DESCRIPTION OF MAIN ELEMENTS

100: oil pump
190: body case
110: lower case
101: bottom plate
102: first body
103: second body
S1: first suction passage
S2: second suction passage
111: first connection passage
111*a*: first communication groove
113: third connection passage
113*a*: second communication groove
D1: first discharge passage
D2: second discharge passage
120: the upper case
121: cooling space
130: gerotor
131: suction part
132: discharge part
133: internal rotor
134: external rotor
135: eccentric hole
150: central case
152: second connection passage
152-1: 2-1-th passage
152-2: 2-2-th passage
152-3: 2-3-th passage
153: cooling inflow passage
154: cooling leakage passage
155: seating part
156: shaft through hole
160: electric motor
161: stator
162: rotor
165: shaft

What is claimed is:

1. An electronic oil pump comprising:

a body case having a first side where a first suction passage and a first discharge passage of a fluid are formed, and having a gerotor installed therein;

an upper case having a first side open, having a cooling space formed therein, and having the body case coupled to an open surface of the first side of the upper case;

the gerotor installed in the body case, including an internal rotor and an external rotor engaged with each other to be eccentrically rotated, a suction part of the gerotor communicating with the first suction passage, and a discharge part of the gerotor communicating with the first discharge passage; and an electric motor installed in the cooling space, and including a shaft for transmitting a rotational force to the gerotor, wherein the body case includes:

a cooling inflow passage for supplying the fluid in the discharge part to the cooling space by allowing the discharge part of the gerotor and the cooling space to communicate with each other; and a second discharge passage for supplying the fluid in the cooling space to the first discharge passage by allowing the cooling space and the first discharge passage to communicate with each other, wherein the body case further includes a second suction passage branched off from the first suction passage, and communicating with the suction part of the gerotor, wherein the body case includes:

a lower case having a first side where the first suction passage and first discharge passage of the fluid are formed, and a central case coupled to a second side of the lower case and having a first side where a seating part on which the gerotor is seated is formed, and the second suction passage includes a first connection passage and a second connection passage, the first connection passage being formed in the lower case, and having an upstream end communicating with the first suction passage and a downstream end connected to the second connection passage, and the second connection passage being formed in the central case, and having an upstream end communicating with the first connection passage and a downstream end connected to the suction part of the gerotor.

2. The pump of claim 1, wherein the central case is made of the same material as the lower case or a material having high thermal conductivity.

3. The pump of claim 1, wherein the lower case includes a bottom plate having an upstream end of the first suction passage and a downstream end of the first discharge passage formed therein, and a first body having a smaller diameter than that of the bottom plate and protruding to a second side of the bottom plate, the central case includes a second body having a cylindrical shape in a shaft direction, and the seating part having a smaller diameter than that of the second body and recessed by a certain distance from a first surface of the second body toward a second surface of the second body, the first connection passage is formed as a groove by being recessed by a certain distance from a first end of the first body to a second side of the first body while passing through in a radial direction for its radial inner side to communicate with the first suction passage and its radial outer side to communicate with the second connection passage, and the second connection passage includes:

a 2-1-th passage recessed from an outer surface of the second body to its radial inner side, and formed from the first surface of the second body to the second surface of the second body in a length direction to communicate with the downstream end of the first connection passage, a 2-2-th passage passing through the second body in the radial direction for its upstream end to communicate with the 2-1 passage and its downstream end to communicate with the seating part, and a 2-3-th passage recessed from a second surface of the seating part toward a second side of the seating part for its upstream end to communicate with the 2-2 passage and its downstream end to communicate with the suction part of the gerotor which is seated on the seating part.

4. The pump of claim 3, wherein the cooling inflow passage passes through the second surface of the seating part to the second surface of the second body for its upstream end to communicate with the discharge part of the gerotor which is seated on the seating part, and its downstream end to communicate with the cooling space.

5. The pump of claim 3, wherein the upper case accommodates the central case in its center in the shaft direction, has an inner circumferential surface in close contact with and coupled to an outer circumferential surface of the second body, and has one end in contact with and coupled to a circumference of the second side of the bottom plate and an inner surface of the one end in contact with and coupled to an outer surface of the first body.

6. An electronic oil pump comprising:

a body case having a first side where a first suction passage and a first discharge passage of a fluid are formed, and having a gerotor installed therein;

an upper case having an open surface at a first side, having a cooling space formed therein, and having the body case coupled to the open surface of the first side of the upper case;

the gerotor installed in the body case, including an internal rotor and an external rotor engaged with each other to be eccentrically rotated, a suction part of the gerotor communicating with the first suction passage, and a discharge part of the gerotor communicating with the first discharge passage; and an electric motor installed in the cooling space, and including a shaft for transmitting a rotational force to the gerotor, wherein the body case includes:

a cooling inflow passage for supplying the fluid in the discharge part to the cooling space by allowing the discharge part of the gerotor and the cooling space to communicate with each other; and a second discharge passage for supplying the fluid in the cooling space to the first discharge passage by allowing the cooling space and the first discharge passage to communicate with each other, wherein the body case includes:

a lower case having a first side where the first suction passage and the first discharge passage of the fluid are formed, and a central case coupled to a second side of the lower case and having a first side where a seating part on which the gerotor is seated is formed, and the second discharge passage includes a cooling leakage passage and a third connection passage, the cooling leakage passage being formed in the central case, and having an upstream end communicating with the cooling space and a downstream end communicating with the third connection passage, and the third connection passage being formed in the lower case, and having an upstream end communicating with the cooling leakage passage and a downstream end communicating with the first discharge passage.

7. The pump of claim 6, wherein the lower case includes a bottom plate having an upstream end of the first suction passage and a downstream end of the first discharge passage formed therein, and a first body having a smaller diameter than that of the bottom plate and protruding to a second side of the bottom plate, the central case includes a second body having a cylindrical shape in a shaft direction, and the seating part having a smaller diameter than that of the second body and recessed by a certain distance from a first surface of the second body toward a second surface of the second body, the cooling leakage passage is recessed from an outer surface of the second body to its radial inner side, and formed from the first surface of the second body to the second surface of the second body in a length direction for a second side of the second body to communicate with the cooling space and the first side to communicate with the third connection passage, and the third connection passage is formed as a groove by being recessed by a certain distance from a first end of the first body to a second end of the first body while passing through in a radial direction and by including a groove recessed by a certain distance from a radial outer side of the first body to its radial inner side for its radial outer side to communicate with the cooling leakage passage and its radial inner side to communicate with the first discharge passage.

* * * * *